US007402771B2

(12) United States Patent
Ye et al.

(10) Patent No.: US 7,402,771 B2
(45) Date of Patent: Jul. 22, 2008

(54) CIRCUIT BREAKER

(75) Inventors: Xiangyang Ye, Künten (CH); Frank Wolter, Heidelberg (DE); Helmut Heiermeier, Wutöschingen (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 11/634,076

(22) Filed: Dec. 6, 2006

(65) Prior Publication Data

US 2007/0075044 A1 Apr. 5, 2007

Related U.S. Application Data

(63) Continuation of application No. PCT/CH2005/000295, filed on May 25, 2005.

(30) Foreign Application Priority Data

Jun. 7, 2004 (EP) ..... 04405351

(51) Int. Cl.
*H01H 33/88* (2006.01)

(52) U.S. Cl. ..... 218/59; 218/51; 218/43

(58) Field of Classification Search ..... 218/43, 218/46, 47, 51–54, 56, 57, 59–66, 72, 73, 218/90, 157
See application file for complete search history.

(56) References Cited

U.S. PATENT DOCUMENTS

| | | | | |
|---|---|---|---|---|
| 2,345,375 | A | 3/1944 | Bennett | |
| 4,471,187 | A | 9/1984 | Sturzenegger et al. | |
| 4,684,773 | A | 8/1987 | Niemeyer | |
| 6,646,850 | B1 | 11/2003 | Bergmann et al. | |
| 6,717,791 | B1 * | 4/2004 | Wiesinger | 218/157 |
| 7,022,922 | B2 * | 4/2006 | Nowakowski | 200/12 |
| 7,041,928 | B2 * | 5/2006 | Nowakowski | 218/59 |
| 2005/0150868 | A1 * | 7/2005 | Nowakowski | 218/57 |

FOREIGN PATENT DOCUMENTS

| | | |
|---|---|---|
| CH | 645 753 | 10/1984 |
| DE | 199 53 560 C1 | 6/2001 |
| EP | 1 105 898 B1 | 6/2001 |
| WO | 03/096366 A1 | 11/2003 |

OTHER PUBLICATIONS

PCT/ISA/210.
PCT/ISA/237.
EPO Form 1507.0.

* cited by examiner

*Primary Examiner*—Elvin Enad
*Assistant Examiner*—Marina Fishman
(74) *Attorney, Agent, or Firm*—Buchanan Ingersoll & Rooney PC

(57) ABSTRACT

An exemplary circuit breaker has in an enclosure filled with an insulating gas at least one interrupting chamber extending along a longitudinal axis. The interrupting chamber can be configured radially symmetrically and contains an arcing volume and at least two associated arcing contacts. The arcing volume is actively connected to at least one exhaust having an exhaust volume. The exhaust is constructed for cooling hot gases generated during breaking operations and is connected to a volume of the interrupting chamber. The breaking capacity of this circuit breaker can be increased significantly and the exhaust can be constructed in a comparatively simple and cost effective manner. This can be achieved by providing in the area of the exhaust at least one forcibly created recirculation area which increases the flow resistance of the hot gases.

27 Claims, 4 Drawing Sheets

CIRCUIT BREAKER

CROSS REFERENCE TO RELATED APPLICATIONS

This application claims priority under 35 U.S.C. §119 to EP Application 04405351.0 filed in the European Patent Office on 7 Jun. 2004, and as a continuation application under 35 U.S.C. §120 to PCT/CH2005/000295 filed as an International Application on 25 May 2005 designating the U.S., the entire contents of which are hereby incorporated by reference in their entireties.

BACKGROUND INFORMATION

From patent specification CH 645 753, a circuit breaker can be used in an electrical high-voltage grid. This circuit breaker has a rotationally symmetrical interrupting chamber which is filled with a dielectrically inert gas, for example with $SF_6$ gas, as quenching and insulating medium. The interrupting chamber has an arcing volume in which the quenching and insulating medium is ionized and heated up by the breaking arc burning between two arcing contact pieces. A part of this heated quenching and insulating medium flows off through an insulating nozzle into an exhaust volume where it is cooled and redirected by means of a cooling device. Mixing the heated quenching and insulating medium with the cold gas existing in the exhaust is possible only to a comparatively small extent since the predominant part of the cold gas is pressed out of the exhaust by the heated quenching and insulating medium before any significant mixing is possible. The flow resistance with which the cooling device opposes the flowing gas is kept as low as possible in this circuit breaker. The cooled and deionized quenching and insulating medium is then available again for further switching processes.

The cooling device has cooling plates which are elaborately shaped to aid the flow and must be elaborately held and, in addition, are manufactured of a metal which is resistant to burn-off loss or wear and is therefore comparatively expensive. Cooling of the heated quenching and insulating medium by mixing it with cold gas only occurs here to a very slight extent.

SUMMARY

A circuit breaker has a distinctly increased breaking capacity, the exhaust of which is constructed comparatively simply and inexpensively and which cools the hot gases in a particularly effective manner.

The circuit breaker has in an enclosure filled with an insulating gas at least one interrupting chamber extending along a longitudinal axis. The interrupting chamber can be constructed radially symmetrically, containing an arcing volume and at least two associated arcing contacts. The arcing volume is actively connected to at least one exhaust having an exhaust volume. The exhaust is constructed for cooling hot gases generated during breaking operations and is connected to a volume of the interrupting chamber. In the area of the exhaust, at least one forcibly created recirculation area can be provided which increases the flow resistance of the hot gases.

In one exemplary circuit breaker, the hot gases, during breaking, flow from the arcing volume into an intermediate volume in which at least one baffle plate protruding into the flow of the hot gases is provided. The intermediate volume is attached to a flow tube constructed in the manner of a laval nozzle and having a nozzle constriction, which flow tube leads into the exhaust volume connected to the interrupting chamber volume.

An exemplary embodiment of the circuit breaker is constructed in such a manner that between the entry of the hot gases into the intermediate volume and the baffle plate, a distance $L_1$ is provided, that between the baffle plate and the nozzle constriction, a distance $L_2$ is provided, that between the nozzle constriction and an exit edge of the flow tube a distance $L_3$ is provided, and that between the distances the following relationship applies: $L_2=0.7*L_1$ and that the length $L_3$ of the flow tube is within a range of twice to three times the diameter of the nozzle constriction of the flow tube.

In another exemplary embodiment of the circuit breaker, means are provided in the exhaust volume which deflect the flow of the hot gases by up to 180°.

A variant of the circuit breaker suitable for extremely large breaking powers can have openings in the flow tube which provide for an additional entry of gas into the flow tube so that at least one second forcibly created recirculation area is formed in which the hot gases are particularly effectively mixed with colder gas and cooled.

The advantages achieved by the various embodiments can be seen in effect that, due to particularly good cooling of the hot gases, a progressive reduction in volume of these, and thus optimal flow-off of the hot gases out of the arcing volume is ensured so that a distinctly higher breaking capacity of the circuit breaker is achieved, the dimensions of the interrupting chamber remaining approximately the same.

At the same time, reliability on switching-off the circuit breaker is also advantageously increased.

The further advantageous embodiments of the invention are the subject matter of the dependent claims.

DESCRIPTION OF THE DRAWING

The invention, its improvements and the advantages achieved thereby are explained in greater detail by means of exemplary embodiments illustrated in the drawings, wherein.

In all figures, identically acting elements are provided with identical reference symbols. Any elements not required for the direct understanding of the invention are not shown or not described, respectively.

DETAILED DESCRIPTION

Figure 1:
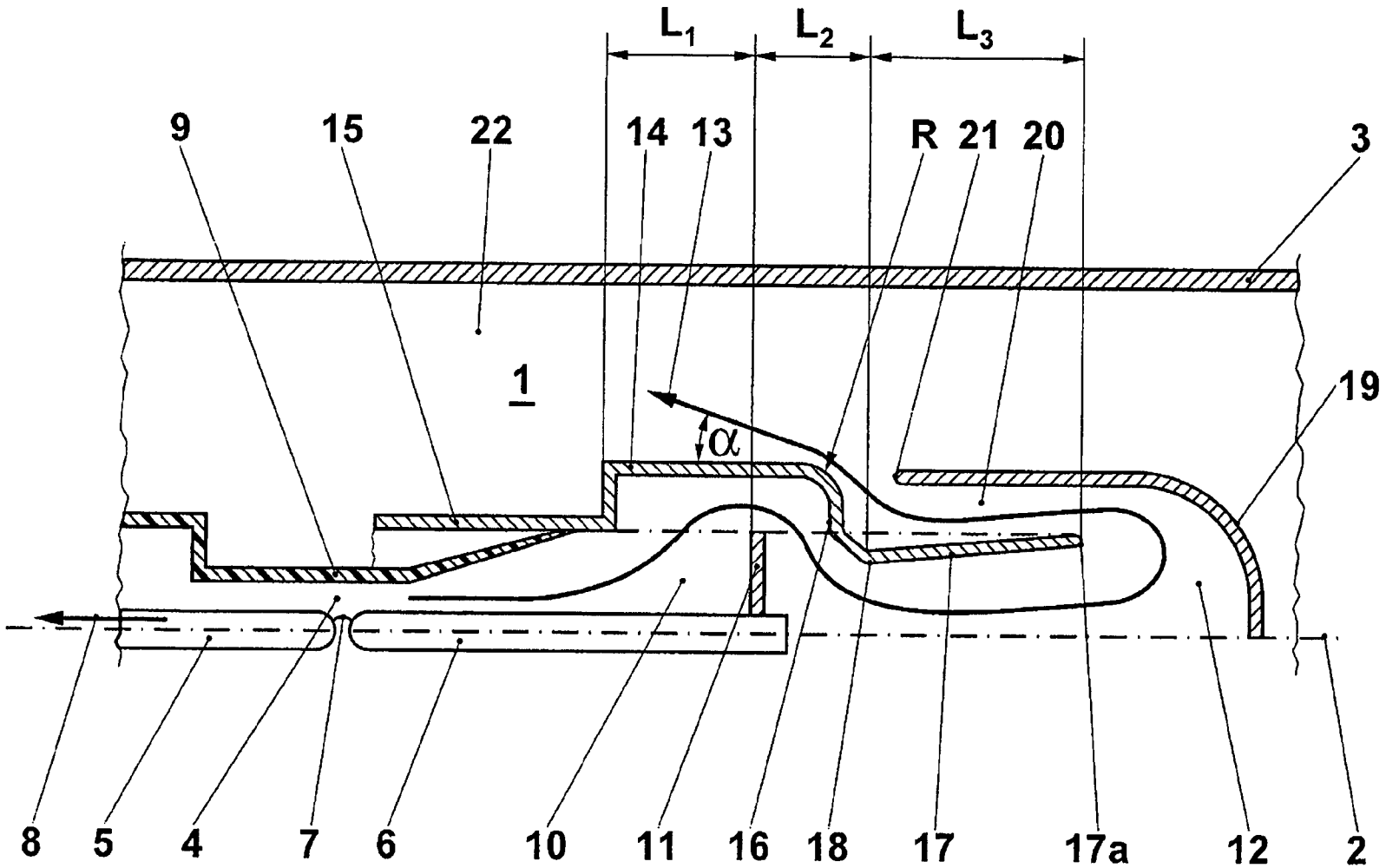
FIG. 1 shows a partial section through a greatly simplified and diagrammatically represented interrupting chamber of an exemplary embodiment of an encapsulated circuit breaker.

A circuit breaker can have one or more series-connected interrupting chambers filled with an insulating gas, which operate in accordance with one of the conventional switching principles, that is to say, for example, as self-blowing or self-extinguishing chamber, as self-blowing chamber with at least one additional compression piston or puffer arrangement or as simple puffer breaker. The circuit breaker can be constructed as encapsulated circuit breaker and metal or plastic can be chosen as encapsulating material. Thus, the circuit breaker can be constructed, for example, as life-tank or outdoor breaker, as part of metal-encapsulated gas-insulated switchgear or as dead-tank breaker. FIG. 1 shows a partial section through the interrupting chamber 1, shown simplified and diagrammatically, of an exemplary embodiment of a circuit breaker during a switching-off process, the parallel nominal-current path being present, in addition to the power-current path shown, not being represented.

This interrupting chamber 1 can be constructed, for example, rotationally symmetrically and extends along a longitudinal axis 2. The interrupting chamber 1 can be enclosed gastight by a concentrically arranged and grounded metal enclosure 3. The electrically insulating holders which fix the interrupting chamber 1 in the metal enclosure 3 are not shown. The interrupting chamber 1 has an arcing volume 4 in which an arc 7 is burning between two rod-shaped arcing contacts 5 and 6 during the switching-off operation. The arcing contact 5 can be constructed as moving contact which moves axially in the direction of an arrow 8 during the switching-off operation whereas the arcing contact 6 is constructed as stationary contact but its mechanical attachment is not shown for the sake of simplicity. However, interrupting chamber variants could also be equipped correspondingly with arcing contacts which can be moved on both sides or arcing contacts which are fixed on both sides. The arcing volume 4 is limited in the radial direction by the inside wall of an insulating nozzle 9. The insulating nozzle 9 opens in the direction of an intermediate volume 10. The insulating nozzle 9 can be constructed to be fixed, but can also be movable together with the arcing contact 5, as has been assumed here.

During the switching-off operation the arc 7 heats up the insulating gas in the arcing volume 4 in familiar manner. The predominant part of this heated, ionized and pressurized gas flows off through the insulating nozzle 9 into the intermediate volume 10. This conical hot-gas stream emerging from the insulating nozzle 9 impinges on a baffle plate 11, which, as a rule, is metallic and is attached to the stationary arcing contact 6. This circular baffle plate 11 causes the hot gas flow to be deflected and prevents the hot gas from flowing directly axially onward into an exhaust volume 12. An arrow 13 indicates the general flow direction of this hot gas from the arcing volume 4 into the exhaust region and through the latter.

The intermediate volume 10 is limited in the radial direction by a metallic wall 14. On the side facing the insulating nozzle 9, a tubular stub 15, which has a smaller diameter than the intermediate volume 10 limited towards the outside by the wall 14, is attached to the wall 14 in the axial direction. In this tubular stub 15, the outside of the insulating nozzle 9 is axially guided. On the side facing away from the tubular stub 15, a constriction 16 is attached to the wall 14 of the intermediate volume 10 and limits the intermediate volume 10 on this side. The transition from the wall 14 to the constriction 16 has a radius R. This radius R supports the deflection of the hot gases in the intermediate volume 10. For breaking currents in the range of 40 kA to 70 kA, a radius R in the range of 25 mm is selected as a result of which an exit angle $\alpha$ of around 30° of the cooled exhaust gases is achieved.

The constriction 16 changes into an axially extending metallic flow tube 17 which is constructed in the manner of a laval nozzle and which has on the side facing the intermediate volume 10 a nozzle constriction 18 and which opens towards the exhaust volume 12. The end of the flow tube 17 in the direction of the exhaust volume 12 is called the exit edge 17*a*. The flow tube 17, constructed in the manner of a laval nozzle, accordingly connects the intermediate volume 10 to the exhaust volume 12.

The exhaust volume 12 is limited by a metallic exhaust housing 19 which is constructed to promote flow and which deflects the flow of the hot gas by up to 180°. A cylindrically constructed part of the exhaust housing 19 has approximately the same outside diameter as the intermediate volume 10 and surrounds the flow tube 17, a duct 20 with annular cross section remaining for the flowing and already slightly cooled hot gas between the flow tube and the exhaust housing 19. Between the outside wall of the constriction 16 and an end edge 21 of the exhaust housing 19, a cylindrical exit area remains through which the gas, cooled further, flows obliquely into an interrupting chamber volume 22. The insulating gas in the interrupting chamber volume 22 surrounds the active parts, described above, of the interrupting chamber 1 and insulates them against the metal enclosure 3.

The intermediate volume 10 has a length $L_1$ up to the baffle plate 11. From the baffle plate 11 to the nozzle constriction 18, the distance is called $L_2$ and from the nozzle constriction 18 to the exit edge 17*a*, the flow tube 17 has the length $L_3$. The following ratio of lengths has been found to be particularly advantageous with the cooling performance of the exhaust arrangement: $L_2=0.7*L_1$. If a greater longitudinal extent of the exhaust arrangement is easily possible, values of 70% to 100% of $L_1$ can also be achieved here. The length $L_3$ of the flow tube 17 is advantageously selected in such a manner that it corresponds to three times the diameter of the nozzle constriction 18. However, a satisfactory exhaust capacity is also achieved, if the length $L_3$ of the flow tube 17 is selected in such a manner that it is within the range of twice to three times the diameter of the nozzle constriction 18.

Figure 2:
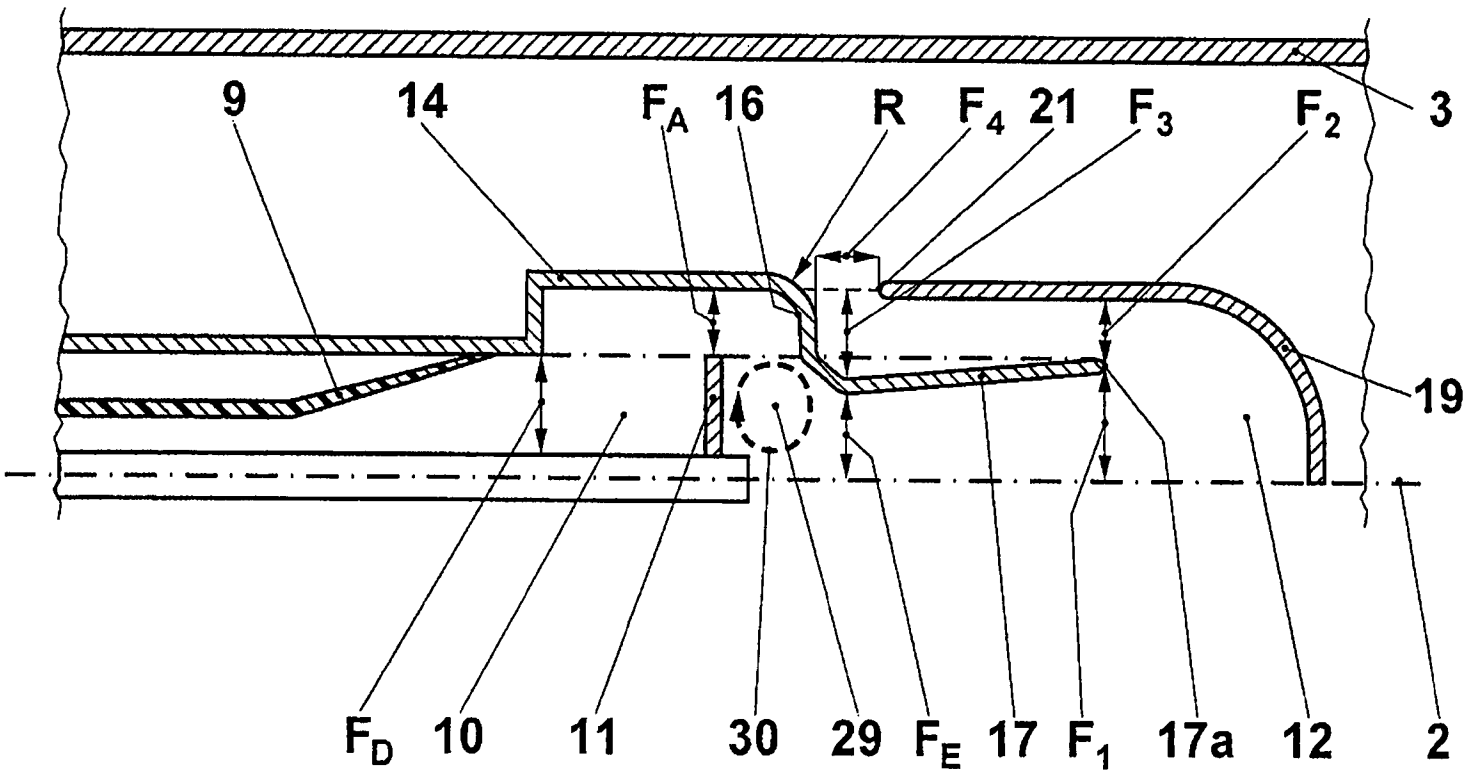
FIG. 2 shows a simplified and diagrammatically represented partial section through an exemplary exhaust area of the interrupting chamber according to FIG. 1.

FIG. 2 shows a simplified and diagrammatically represented partial section through an exemplary exhaust area of the interrupting chamber according to FIG. 1. In this FIG. 2, the cross sections determining for the flow-off of the hot gases out of the arcing volume are designated. An area $F_D$ designates the exit area of the hot gases out of the insulating nozzle 9 or, respectively, the entry area of the hot gases into the intermediate volume 10, the baffle plate 11 has approximately the same effective area as the area $F_D$. An annular area $F_A$ represents the area lying between the baffle plate 11 and the wall 14. An area $F_E$ specifies the cross section of the nozzle constriction 18 of the flow tube 17. An area $F_1$ specifies the exit cross section out of the flow tube 17, the area $F_1$ being approximately of equal magnitude as the area $F_D$. An annular area $F_2$ represents the area which lies between the exit edge 17*a* of the flow tube 17 and the exhaust housing 19. An annular area $F_3$ specifies the cross section lying between the constriction of the flow tube 17 and the imaginary extension of the exhaust housing 19. Between the outside wall of the constriction 16 and the end edge 21 of the exhaust housing 19, a cylindrical exit area $F_4$ remains.

In an optimum exhaust configuration which also comprises the length ratios described above, the area $F_D$, the area of the baffle plate 11 and the area $F_1$, are constructed to be approximately of the same size. The annular area $F_A$ around the baffle plate 11 is constructed in such a manner that it has 30% to 80% of the area $F_D$. An optimum exhaust capacity is obtained when the relationship $F_A=50\%*F_D$ is maintained. As a rule, the areas $F_E$ and $F_2$ are dimensioned in such a manner that they are within a range of 50% to 70% of $F_D$. The annular area $F_3$ is of approximately the same size as the area $F_D$, as is the exit area $F_4$.

Figure 3:
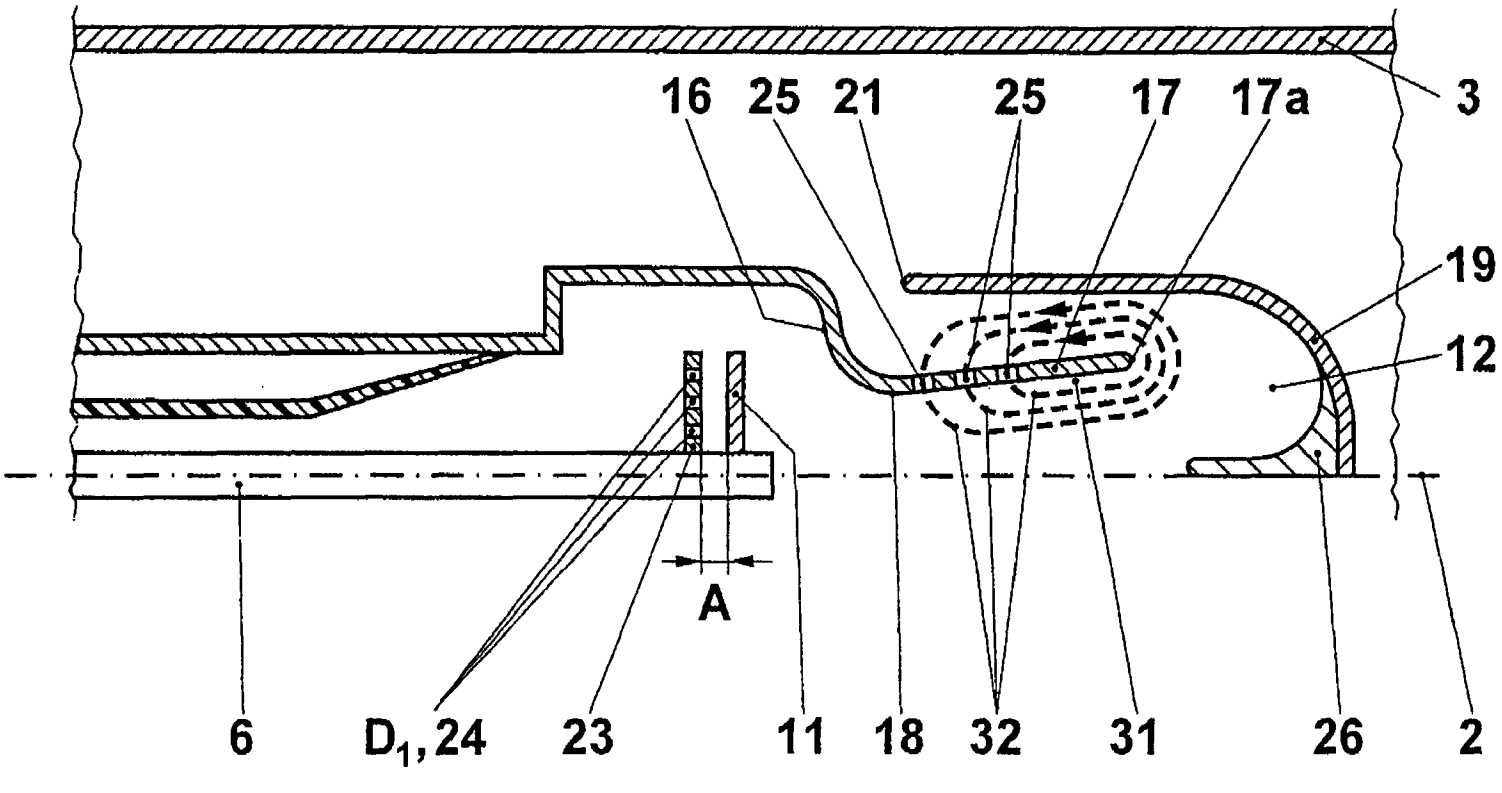
FIG. 3 shows a simplified and diagrammatically represented partial section through another exemplary exhaust variant of the interrupting chamber according to FIG. 1.

FIG. 3 shows another exemplary of the exhaust area as described. Depending on the required breaking capacity of the interrupting chamber 1, the variants described in the text which follows can be used each by itself or also in combinations of twos and threes. Upstream of the baffle plate 11, a second metallic plate, a circularly constructed perforated plate 23, is here installed which is provided with a multiplicity of openings 24. Between the perforated plate 23 and the baffle plate 11, which has approximately the same diameter, a distance A is provided. When these openings 24 in each case have a diameter $F_1$, particularly good cooling of the hot gas is obtained when the ratio $A/D_1$ has a value of 2, but relatively good cooling results are achieved in the entire range $A/D_1$=1.5 to 5. As a rule, the distance between the openings 24 should be in a range of more than twice the diameter $D_1$.

Additional openings 25 can be provided downstream of the nozzle constriction 18 in the flow tube 17. These openings 25 can be of different shapes and connect the interior of the flow tubes 17 with the annular volume outside the flow tube 17. In addition, a deflector 26 constructed to promote flow can be mounted opposite to the opening of the flow tube 17 in the exhaust housing 19, which deflector 26 facilitates the deflection of the hot-gas flow by 180°.

Figure 4:
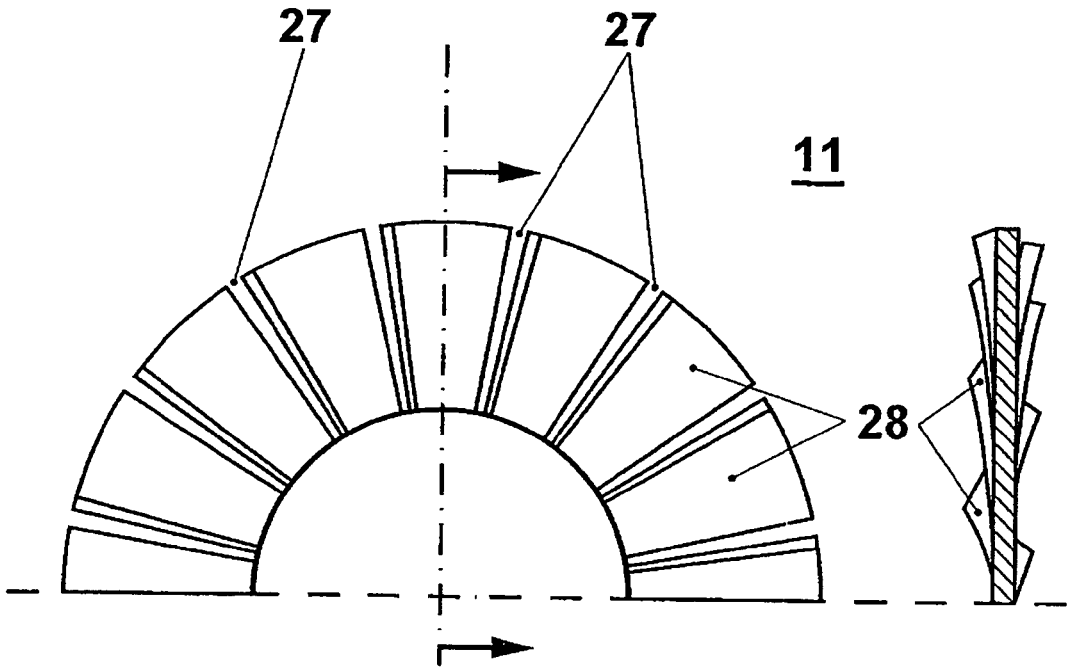
FIG. 4 shows another exemplary of the embodiment of an exhaust detail shown simplified.

FIG. 4 shows another exemplary embodiment of the baffle plate 11 in a top view and as partial section on the right. The circular metallic baffle plate 11 is provided with narrow notches 27 of approximately equal depth and distributed uniformly around the circumference. The wings 28 remaining between the notches 27 are in each case bent by about 30° in the manner of a wind wheel. Constructing the baffle plate 11 in this manner achieves a particularly effective turbulence in the hot-gas flow and, associated therewith, particularly good cooling of this flow. The device for connecting the baffle plate 11 to the arcing contact 6 is not shown.

To explain the operation, the figures described above will now be considered in greater detail. The arrow 13 indicates the general flow of the hot gases created by the arc 7 through the exhaust region of the interrupting chamber 1. After the hot gases flow out of the insulating nozzle 9, they impinge on the baffle plate 11 and are slightly deflected. The baffle plate 11 absorbs thermal energy from the hot gases, as does the wall 14. Due to this cooling, the volume of the flowing hot gas is slightly reduced. The hot gas then flows around the baffle plate 11 and impinges on the constriction 16 where it is again deflected and cooled further by delivering energy to the material of the constriction 16 and its volume is thus reduced.

The area of the intermediate volume 10 which is located downstream of the baffle plate 11 is partially used as a recirculation area 29 for the flowing gas. The area of the recirculation area 29 is diagrammatically shown by an arrow 30 shown dashed. In the recirculation area 29, an effective flow is formed which leads to a particularly good intermixing of the hot gases with the cooler insulating gas located in the intermediate volume 10. Due to this intermixing of the hot gases with the cooler insulating gas located in the intermediate volume 10, the major proportion of the heat energy is removed from the hot gas. The turbulences occurring in the edge areas of the intermediate volume 10 do improve the heat transition from the hot gas into the material of the limiting materials but, as a rule, their contribution to the cooling effect of the exhaust is not significant.

This mixed gas which is cooled further then flows into the flow tube 17 where it is first narrowed down by the nozzle constriction 18. Since the flow tube 17 widens out in the manner of a laval nozzle after the nozzle constriction 18, the flow velocity of the gas is increased there so that a negative pressure is produced which additionally sucks the gas through the nozzle constriction 18. This effect advantageously increases the intensity of the mixing of gases in the area of the recirculation area 29 located downstream of the baffle plate 11. The wall of the flow tube 17 also absorbs and removes heat energy from the hot gases.

The hot gases initially flow away from the arcing volume 4 in predominantly an axial direction but after emerging from the flow tube 17, they are deflected by 180° by the exhaust housing 19 and are guided oppositely to the original flow direction outside the flow tube 17. The metallic exhaust housing 19 also absorbs heat energy which it removes from the hot gas. This heat transition is improved by eddies which are mandatorily produced during the deflection of the gas. This complete redirection of the gas flow reduces the constructional length of the exhaust area with the result of an advantageous reduction in size and thus also a reduction of costs of the interrupting chamber 1. Geometric relationships allowing, it is also easily conceivable to install a comparatively large exhaust volume 12 and then to omit this deflection described.

Afterward, the gas, cooled further, flows on in the direction of the interrupting chamber volume 22 between the outside of the flow tube 17 and the exhaust housing 19. As can be seen from FIG. 2, the annular area $F_2$, through which the gas flows, is smaller at the entry into this area than the annular area $F_3$ or, respectively, the cylindrical exit area $F_4$ when the gas flows out of this exhaust area so that the flow velocity of the gas is distinctly reduced as a result of which the pressure of the gas rises slightly in this area. The transition from the constriction 16 to the wall 14 has a radius R. For breaking currents in the range from 40 kA to 70 kA, a radius R in the range of 25 mm is selected as a result of which an exit angle $\alpha$ of the cooled exhaust gases into the interrupting chamber volume 22 of around 30° is achieved. The oblique exit of the cooled exhaust gases has the result that any ionized particles which may still be present in the gas flow are cooled on a longer path through the cool insulating gas present in the interrupting chamber volume 22 so that they cannot initiate a flashover between the active interrupting chamber parts carrying voltage and the metal enclosure 3 which, as a rule, is grounded. When the gases emerge approximately radially from the cylindrically constructed exit area $F_4$, it may not be possible to ensure adequate dielectric strength in every case.

The exemplary embodiments of the interrupting chamber 1 shown in FIG. 3 improve the performance of the exhaust. The perforated plate 23 mounted in front of the baffle plate 11 quite considerably improves the cooling effect of the baffle plate 11.

In another variant, the openings 25 in the flow tube 17 allow the entry of slightly cooler gases from outside in the interior of the flow tube 17 since the gas pressure outside the flow tube 17 is higher than in its interior. As a consequence, a further recirculation area 31, indicated by dashed arrows 32, forms here in the flow tube 17 and in the duct 20. In this recirculation area 31, which is also generated by force, further intensive mixing of hot and cold gas takes place, associated with even better cooling of the hot gases. Afterwards, the flow velocity of the exhaust gases in the flow tube 17 increases again.

The deflector 26 inserted into the exhaust housing 19 advantageously reduces the flow resistance during the deflection of the gas flow into the opposite direction. In addition, the deflector 26 removes further heat energy from the gas flow.

The circular metallic baffle plate 11 with narrow radial notches 27, distributed around a circumference, as shown in FIG. 4, causes particularly effective turbulence in the hot gas flow. Due to the wings 28, twisted in the manner of a wind wheel, the flow receives a spin which additionally intensifies the flow. Compared with the other embodiments of the baffle plate 11 described, the hot gas flow passing directly through the notches 27 causes an even more intensive intermixing of hot and cold gas in the recirculation area 29 behind the baffle plate 11 and, associated therewith, an even more effective cooling of the hot gases in this area.

All these measures, individually or also in combination, bring with them an advantageous increase in the breaking capacity of the circuit breaker. If further increase in the capacity of the circuit breaker is to be achieved, the geometric construction of the exhaust region of the moving arcing contact 5 opposite the fixed arcing contact 6 is designed in similar manner as the embodiments already described so that the hot gases removed on the side of the moving arcing contact 5 from the arcing volume 4 in the direction of the interrupting chamber volume 22 are also cooled in a similarly effective manner, which is associated with further advantageous reduction in the volume of the flowing hot gas. A circuit breaker, the interrupting chamber or interrupting chambers of which are provided with this improved cooling of the hot gases on both sides has a distinctly higher breaking capacity than a conventional circuit breaker having the same dimensions.

It is also easily possible to configure an exhaust variant without the baffle plate 11 and without the perforated plate 23. In such an exemplary exhaust variant, only the flow tube 17 is provided with the openings 25 so that the recirculation area 31 forms as a single recirculation area during the breaking or switching-off operation of the circuit breaker and provides for intensive cooling of the hot gases in this area. This exhaust variant can also be configured with or without the gas deflection following the flow tube 17.

It will be appreciated by those of ordinary skill in the art that the exemplary circuit breakers described here can be embodied in various specific forms without departing from the essential characteristics thereof. The presently disclosed embodiments are considered in all respects to be illustrative and not restrictive. The scope of the invention is indicated by the appended claims, rather than the foregoing description, and all changes that come within the meaning and range of equivalence thereof are intended to be embraced.

LIST OF DESIGNATIONS

1 Interrupting chamber
2 Longitudinal axis
3 Metal enclosure
4 Arcing volume
5, 6 Arcing contacts
7 Arc
8 Arrow
9 Insulating nozzle
10 Intermediate volume
11 Baffle plate
12 Exhaust volume
13 Arrow
14 Wall
15 Tubular stub
16 Constriction
17 Flow tube
17*a* Exit edge
18 Nozzle constriction
19 Exhaust housing
20 Duct
21 End edge
22 Interrupting chamber volume
23 Perforated plate
24 Openings
25 Openings
26 Deflector
27 Notch
28 Wing
29 Recirculation area
30 Arrow
31 Recirculation area
32 Arrows
$\alpha$ Exit angle
R Radius
$L_1$, $L_2$, $L_3$ Various lengths
$F_D$ Area
$F_A$ Annular area
$F_E$, $F_1$ Area
$F_2$, $F_3$ Annular area
$F_4$ Exit area
A Distance
$D_1$ Diameter

The invention claimed is:

1. A circuit breaker which has in an enclosure filled with an insulating gas at least one interrupting chamber extending along a longitudinal axis comprising:

an arcing volume; and at least two associated arcing contacts, the arcing volume being actively connected to at least one exhaust having an exhaust volume which is constructed for cooling hot gases generated during breaking operations and is connected to a volume of the interrupting chamber, wherein in the area of the exhaust at least one forcibly created recirculation area is provided which increases the flow resistance of the hot gases, wherein the hot gases flow from the arcing volume into an intermediate volume, following the intermediate volume, a flow tube constructed in the manner of a laval nozzle and having a nozzle constriction leads into the exhaust volume which is connected to the interrupting chamber volume, in the intermediate volume, at least one baffle plate protruding into the flow of the hot gases is provided, downstream of which a first recirculation area forms, between the entry for the hot gases into the intermediate volume and the baffle plate, a distance $L_1$ is provided, between the baffle plate and the nozzle constriction, a distance $L_2$ is provided, and that between the nozzle constriction and an exit edge of the flow tube, a distance $L_3$ is provided.

2. The circuit breaker as claimed in claim 1, wherein between the distances the following relationship applies: $L_2=0.7*L_1$, and/or that the length $L_3$ of the flow tube is within a range of twice to three times the diameter of the nozzle constriction of the flow tube.

3. The circuit breaker as claimed in claim 1, wherein in the exhaust volume, means are provided which deflect the flow of the hot gases by up to 180°.

4. The circuit breaker as claimed in claim 2, wherein the baffle plate has approximately the same effective area as an entry area, designated as area $F_D$, of the hot gases into the intermediate volume, and/or the cross section, designated as area $F_1$, of the flow tube is constructed to be of the same size in the area of the exit edge as the area $F_D$, and/or an annular area $F_A$, located between the baffle plate and the wall, has 30% to 80% of the area $F_D$, and/or an area $F_E$, which represents the cross section of the nozzle constriction of the flow tube, has 50% to 70% of the area $F_D$.

5. The circuit breaker as claimed in claim 4, wherein the annular area $F_A$ has approximately 50% of the area $F_D$.

6. The circuit breaker as claimed in claim 5, wherein in the exhaust volume, means are provided which deflect the flow of the hot gases by up to 180°.

7. The circuit breaker as claimed in claim 6, wherein following the nozzle constriction which is arranged in the flow tube constructed in the manner of a laval nozzle and attached to the intermediate volume, openings are provided in the wall of the flow tube which enable gas to enter into the interior of the flow tube, as a result of which at least one second recirculation area is mandatorily generated during a switching-off operation.

8. A circuit breaker which has in an enclosure filled with an insulating gas at least one interrupting chamber extending along a longitudinal axis comprising:

an arcing volume; and at least two associated arcing contacts, the arcing volume being actively connected to at least one exhaust having an exhaust volume which is constructed for cooling hot gases generated during breaking operations and is connected to a volume of the interrupting chamber, wherein in the area of the exhaust at least one forcibly created recirculation area is provided which increases the flow resistance of the hot gases, wherein the hot gases flow from the arcing volume into an intermediate volume, following the intermediate volume, a flow tube constructed in the manner of a laval nozzle and having a nozzle constriction leads into the exhaust volume which is connected to the interrupting chamber volume, in the intermediate volume, at least one baffle plate protruding into the flow of the hot gases is provided, downstream of which a first recirculation area forms, and the baffle plate has approximately the same effective area as an entry area, designated as area $F_D$, of the hot gases into the intermediate volume, and/or the cross section, designated as area $F_1$, of the flow tube is constructed to be of the same size in the area of the exit edge as the area $F_D$, and/or an annular area $F_A$, located between the baffle plate and the wall, has 30% to 80% of the area $F_D$, and/or an area $F_E$, which represents the cross section of the nozzle constriction of the flow tube, has 50% to 70% of the area $F_D$.

9. The circuit breaker as claimed in claim 8, wherein the annular area $F_A$ has approximately 50% of the area $F_D$.

in the exhaust volume, means are provided which deflect the flow of the hot gases by up to 180°.

10. A circuit breaker which has in an enclosure filled with an insulating gas at least one interrupting chamber extending along a longitudinal axis comprising:

an arcing volume; and at least two associated arcing contacts, the arcing volume being actively connected to at least one exhaust having an exhaust volume which is constructed for cooling hot gases generated during breaking operations and is connected to a volume of the interrupting chamber, wherein in the area of the exhaust at least one forcibly created recirculation area is provided which increases the flow resistance of the hot gases, wherein the hot gases flow from the arcing volume into an intermediate volume, following the intermediate volume, a flow tube constructed in the manner of a laval nozzle and having a nozzle constriction leads into the exhaust volume which is connected to the interrupting chamber volume, in the exhaust volume, means are provided which deflect the flow of the hot gases by up to 180°, and an annular area $F_2$, which represents the cross section between the exit edge of the flow tube and the exhaust housing, has 50% to 70% of the area $F_D$, and/or an annular area $F_3$, which specifies the cross section lying between the nozzle constriction of the flow tube and the imaginary extension of the exhaust housing, is constructed to be of approximately the same size as the area $F_D$, and/or between the outside wall of the constriction and an end edge of the exhaust housing, a cylindrical exit area $F_4$ remains which is constructed to be approximately of the same size as the area $F_D$.

11. The circuit breaker as claimed in claim 10 wherein the hot gases are introduced into the interrupting chamber volume at an exit angle $\alpha$ through the cylindrical exit area $F_4$ and the exit angle $\alpha$ is in the range of 30°.

12. The circuit breaker as claimed in claim 10, wherein in the intermediate volume, at least one baffle plate protruding into the flow of the hot gases is provided, downstream of which a first recirculation area forms.

13. The circuit breaker as claimed in claim 12, wherein in the intermediate volume, at least one baffle plate protruding into the flow of the hot gases is provided, downstream of which a first recirculation area forms.

14. The circuit breaker as claimed in claim 13, wherein between the distances the following relationship applies: $L_2=0.7*L_1$, and/or that the length $L_3$ of the flow tube is within a range of twice to three times the diameter of the nozzle constriction of the flow tube.

15. The circuit breaker as claimed in claim 12, wherein the baffle plate has approximately the same effective area as an entry area, designated as area $F_D$, of the hot gases into the intermediate volume, and/or the cross section, designated as area $F_1$, of the flow tube is constructed to be of the same size in the area of the exit edge as the area $F_D$, and/or an annular area $F_A$, located between the baffle plate and the wall, has 30% to 80% of the area $F_D$, and/or an area $F_E$, which represents the cross section of the nozzle constriction of the flow tube, has 50% to 70% of the area $F_D$.

16. The circuit breaker as claimed in claim 15, wherein the annular area $F_A$ has approximately 50% of the area $F_D$.

17. A circuit breaker which has in an enclosure filled with an insulating gas at least one interrupting chamber extending along a longitudinal axis comprising:

an arcing volume; and at least two associated arcing contacts, the arcing volume being actively connected to at least one exhaust having an exhaust volume which is constructed for cooling hot gases generated during breaking operations and is connected to a volume of the interrupting chamber, wherein in the area of the exhaust at least one forcibly created recirculation area is provided which increases the flow resistance of the hot gases, wherein the hot gases flow from the arcing volume into an intermediate volume, following the intermediate volume, a flow tube constructed in the manner of a laval nozzle and having a nozzle constriction leads into the exhaust volume which is connected to the interrupting chamber volume, in the intermediate volume, at least one baffle plate protruding into the flow of the hot gases is provided, downstream of which a first recirculation area forms, and following the nozzle constriction which is arranged in the flow tube constructed in the manner of a laval nozzle and attached to the intermediate volume, openings are provided in the wall of the flow tube which enable gas to enter into the interior of the flow tube, as a result of which at least one second recirculation area is mandatorily generated during a switching-off operation.

18. The circuit breaker as claimed in claim 17, wherein in the intermediate volume, at least one baffle plate protruding into the flow of the hot gases is provided, downstream of which a first recirculation area forms.

19. The circuit breaker as claimed in claim 18, wherein between the entry for the hot gases into the intermediate volume and the baffle plate, a distance $L_1$ is provided, between the baffle plate and the nozzle constriction, a distance $L_2$ is provided, and that between the nozzle constriction and an exit edge of the flow tube, a distance $L_3$ is provided.

20. The circuit breaker as claimed in claim 19, wherein between the distances the following relationship applies: $L_2=0.7*L_1$, and/or that the length $L_3$ of the flow tube is within a range of twice to three times the diameter of the nozzle constriction of the flow tube.

21. The circuit breaker as claimed in claim 17, wherein an annular area $F_2$, which represents the cross section between the exit edge of the flow tube and the exhaust housing, has 50% to 70% of the area $F_D$, and/or an annular area $F_3$, which specifies the cross section lying between the nozzle constriction of the flow tube and the imaginary extension of the exhaust housing, is constructed to be of approximately the same size as the area $F_D$, and/or between the outside wall of the constriction and an end edge of the exhaust housing, a cylindrical exit area $F_4$ remains which is constructed to be approximately of the same size as the area $F_D$.

22. The circuit breaker as claimed in claim 21, wherein the hot gases are introduced into the interrupting chamber volume at an exit angle $\alpha$ through the cylindrical exit area $F_4$ and the exit angle $\alpha$ is in the range of 30°.

23. A circuit breaker which has in an enclosure filled with an insulating gas at least one interrupting chamber extending along a longitudinal axis comprising:

an arcing volume; and at least two associated arcing contacts, the arcing volume being actively connected to at least one exhaust having an exhaust volume which is constructed for cooling hot gases generated during breaking operations and is connected to a volume of the interrupting chamber, wherein in the area of the exhaust at least one forcibly created recirculation area is provided which increases the flow resistance of the hot gases, wherein the hot gases flow from the arcing volume into an intermediate volume, following the intermediate volume, a flow tube constructed in the manner of a laval nozzle and having a nozzle constriction leads into the exhaust volume which is connected to the interrupting chamber volume, in the intermediate volume, at least one baffle plate protruding into the flow of the hot gases is provided, downstream of which a first recirculation area forms, and the baffle plate is preceded upstream at a distance A by a perforated plate which is provided with openings which have a diameter $D_1$.

24. The circuit breaker as claimed in claim 23, wherein the ratio $A/D_1$ has a value in the range of 1.5 to 5, preferably a value of 2, and wherein the distance between the openings is in the area of greater than twice the diameter $D_1$.

25. A circuit breaker which has in an enclosure filled with an insulating gas at least one interrupting chamber extending along a longitudinal axis comprising:

an arcing volume; and at least two associated arcing contacts, the arcing volume being actively connected to at least one exhaust having an exhaust volume which is constructed for cooling hot gases generated during breaking operations and is connected to a volume of the interrupting chamber, wherein in the area of the exhaust at least one forcibly created recirculation area is provided which increases the flow resistance of the hot gases, wherein the hot gases flow from the arcing volume into an intermediate volume, following the intermediate volume, a flow tube constructed in the manner of a laval nozzle and having a nozzle constriction leads into the exhaust volume which is connected to the interrupting chamber volume, in the intermediate volume, at least one baffle plate protruding into the flow of the hot gases is provided, downstream of which a first recirculation area forms, the baffle plate is provided with narrow notches of equal depth and distributed uniformly around the circumference, and the wings remaining between the notches are constructed to be bent over in the manner of a wind wheel.

26. The circuit breaker as claimed in claim 25, wherein the baffle plate is preceded upstream at a distance A by a perforated plate which is provided with openings which have a diameter $D_1$.

27. The circuit breaker as claimed in claim 26, wherein the ratio $A/D_1$ has a value in the range of 1.5 to 5, preferably a value of 2, and wherein the distance between the openings is in the area of greater than twice the diameter $D_1$.

* * * * *